US005588942A

United States Patent [19]

Dillard

[11] Patent Number: 5,588,942

[45] Date of Patent: Dec. 31, 1996

[54] ADJUSTABLE EXERCISE DEVICE

[76] Inventor: Keith A. Dillard, 9108 Helena Rd., Pelham, Ala. 35124

[21] Appl. No.: 426,915

[22] Filed: Apr. 21, 1995

[51] Int. Cl.[6] ..... A63B 21/00

[52] U.S. Cl. ..... 482/139; 482/92; 482/908; 482/106

[58] Field of Search ..... 482/24, 37, 44, 482/45, 49, 50, 72, 92, 91, 93, 100, 104, 106–108, 117, 126, 139, 148, 908, 38, 99, 143, 907; 601/24, 33; 602/34; 5/503.1, 662

[56] References Cited

U.S. PATENT DOCUMENTS

| | | | |
|---|---|---|---|
| 247,403 | 9/1881 | Pistorius | 5/662 |
| 798,114 | 8/1905 | Rosenthal | 5/662 |
| 1,840,170 | 1/1932 | Neils | 5/662 |
| 2,706,632 | 4/1955 | Chandler | 482/24 |
| 3,421,760 | 1/1969 | Freeman, Jr. | 482/139 |
| 4,629,184 | 12/1986 | Selkee | 482/139 |
| 4,743,018 | 5/1988 | Eckler | 482/106 |
| 4,936,572 | 6/1990 | Desiderio | 482/142 |
| 4,949,951 | 8/1990 | Deola | 482/138 |
| 5,372,558 | 12/1994 | Perry et al. | 482/93 |
| 5,399,133 | 3/1995 | Haber et al. | 482/139 |

FOREIGN PATENT DOCUMENTS

| | | | |
|---|---|---|---|
| 2500743 | 9/1982 | France | 5/503.1 |
| 367023 | 2/1932 | United Kingdom | 5/662 |

*Primary Examiner*—Richard J. Apley
*Assistant Examiner*—Victor K. Hwang
*Attorney, Agent, or Firm*—Watson Cole Stevens Davis

[57] ABSTRACT

First and second rigid bars may be connected together by a support to form an elongated bar assembly having a longitudinal axis. A pair of hand grips are spaced from one another, and each hand grip includes a mounting portion which is freely pivotally supported on a bar for pivotal movement about pivot axis extending substantially perpendicular to the longitudinal axis of the bar assembly. A hand grip portion is supported on the mounting portion for swivel movement through 360 degrees about an axis of rotation disposed substantially perpendicular to and passing through the pivot axis at the point where the mounting portion is pivotally supported by the bar assembly. The swivel connection can be locked to prevent swiveling of the hand grip portion.

14 Claims, 3 Drawing Sheets

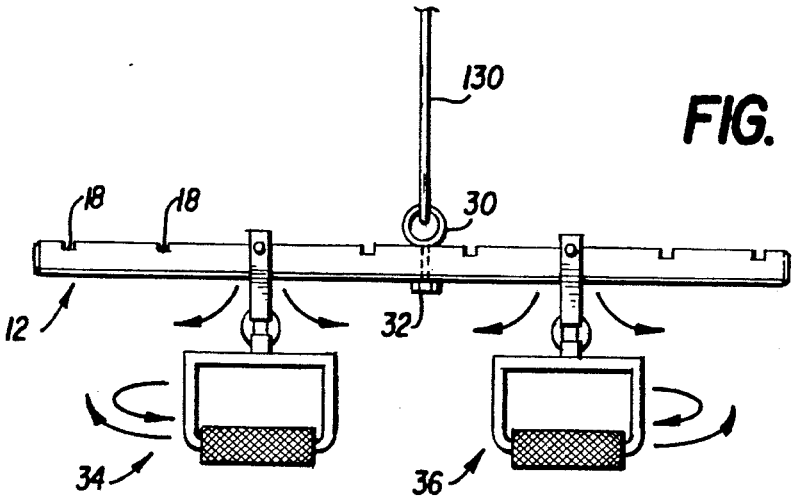
FIG. 6
FIG. 7
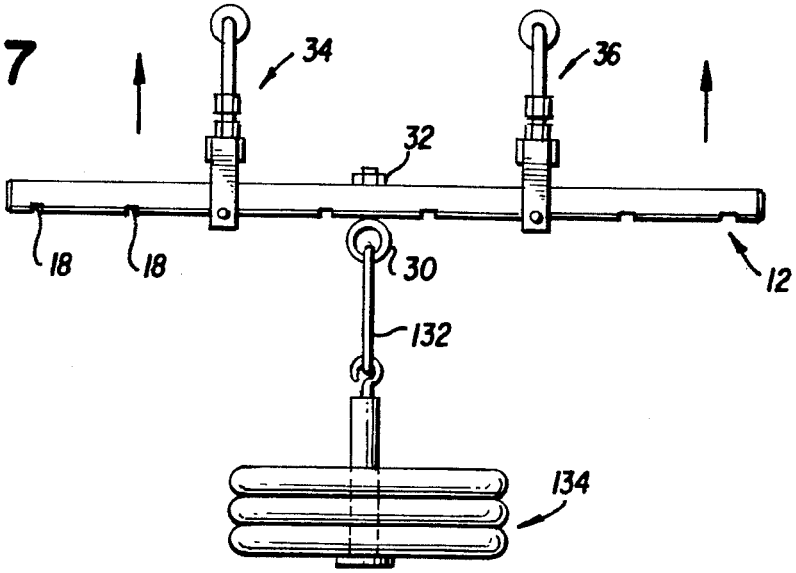
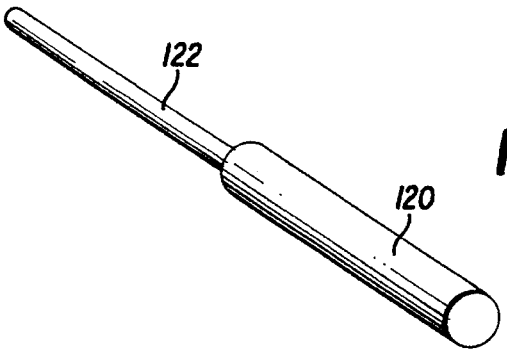
FIG. 8

ADJUSTABLE EXERCISE DEVICE

BACKGROUND OF THE INVENTION

The present invention relates to an adjustable exercise device, and more particularly to an exercise device which is especially adapted to exercise the upper and lower muscles of the back. Additionally, the device is adapted to work the triceps, biceps and shoulder muscles from almost every angle imaginable for more complete and thorough development of these muscles.

The invention relates to the type of exercise device having a pair of hand grips which are adapted to be gripped by the hands of a user, and wherein it is desirable to vary the width of the hand grips as well as the angular orientation of the hand grips while exercising with the device. With such a construction, many different types of exercises may be carried out to work the various muscles of the upper body. It is desirable that the device can be used in various manners such as with weight machines, free weights or as a chin-up pull-up bar. Furthermore, it is desirable that the device should be of such a construction that it can be readily transported to and from a gym while being capable of being disassembled and stored in a relatively small space.

The prior art requires the use of many different specialty bars in order to perform a variety of different exercises. Known devices provide a limited number of widths of adjustment of the hand grips, and the angular position of the hand grips is also limited so that the range of movement during exercises prevents some types of exercises from being carried out. In particular, prior art devices do not permit simultaneous width and rotational adjustments of the hand grips to be made so that slight width changes can occur during certain exercises which is a very desirable feature since such a mode of operation keeps pressure off the wrists and forearms of a user.

SUMMARY OF THE INVENTION

The fully assembled invention employs a pair of bars connected together which can be anchored overhead and used as a universal chin-up bar, or it can be attached to a weight stack machine and used for a variety of lat pull downs. When the device is disassembled, one of the bars of the device may be used with free weights or a weight machine in order to perform a variety of rowing exercises, shoulder presses or bicep and tricep exercises.

The assembled device employs a pair of rigid bars connected to one another with a hand grip supported by each bar. Each hand grip includes a hand grip portion and a mounting portion. The mounting portion of each hand grip is pivotally supported on one of said bars. Each hand grip portion is supported on an associated mounting portion by a swivel connection so that the hand grip portion can swivel with respect to the support portion. One of the rigid bars can be separated from the other bar so that either a wide or narrow bar arrangement can be used. This permits the hand grips to be moved to either a wide or narrow hand grip position. As an exercise is being performed, the distance between the hand grips can adjust to be slightly wider or narrower in order to keep pressure off the wrists and on the muscles to be developed.

The hand grip portions can swivel through an angle of 360 degrees with respect to the mounting portion of the hand grips, and means is provided for selectively locking the hand grip in any desired position with respect to the mounting portion so that no movement can occur between these components.

The construction of the invention provides many different initial spacings between the hand grips and permits simultaneous width and rotational adjustments of the hand grips while exercising. The distance of the hand grip portion from the supporting bar and the angle to the supporting bar also changes during certain exercises. This mode of operation keeps pressure off the wrists and forearms. The invention provides a tremendous number of initial positions of the hand grips for numerous different exercises, and the grips may move into numerous different planes while the exercises are performed.

The invention device can be set up and changed in an easy and rapid manner. The space between the hand grips portions may be varied widely, and in a typical example may be varied between about four to fifty-eight inches. More pulling positions are provided in the invention than in prior art devices, thereby involving and developing more muscles. The invention construction allows deeper and longer pulling motion without chest, neck or wrist interference.

BRIEF DESCRIPTION OF THE DRAWINGS

FIG. 6 is a view showing-a single bar used with a weight machine;

FIG. 7 is a view showing a single bar used with free weights; and

FIG. 8 is a perspective view of a tool used with the device.

DESCRIPTION OF THE PREFERRED EMBODIMENT

Figure 1:
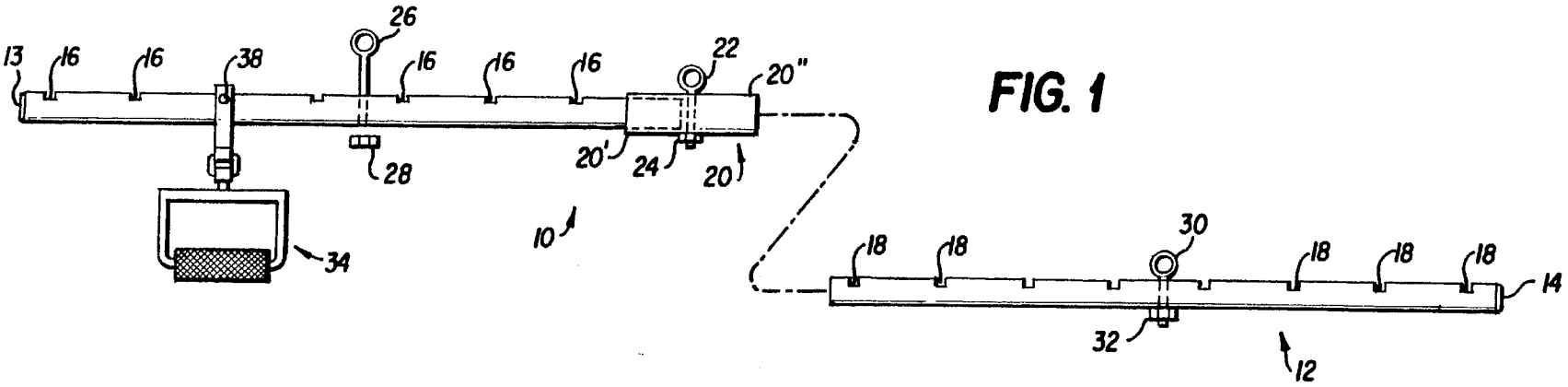
FIG. 1 is an exploded view of the invention device.

Referring now to the drawings wherein like reference characters designate corresponding parts throughout the several views, as seen in FIG. 1, the device includes a first rigid bar 10 and a second separate rigid bar 12 of similar construction. Each bar is formed of a strong material such as steel and is of tubular construction having a generally square cross-sectional configuration and being open at opposite ends. Plastic inserts 13 and 14 are inserted in one open end of bars 10 and 12 respectively to close off the ends and present a neat appearance.

The upper portion of bar 10 has a plurality of spaced slots 16 formed therein, the slots being shown as eight in number, although the number and spacing of the slots may be varied. In a typical example, bar 10 may be about thirty inches in length, and the centers of the slots may be spaced about four inches from one another. Bar 12 is of similar construction to bar 10 and has eight slots 18 formed in the upper portion thereof.

A support 20 formed of steel or the like is also of tubular construction open at both ends and having a generally square cross-sectional configuration with an inner dimension sized to receive ends of bars 10 and 12. In a typical example, the support may be about six inches in length. One end 20' of support 20 has a press fit with the associated end of the first bar 10 so that these two components are permanently connected to one another. The other end 20" of support 20 has a sliding fit with the associated end of the second bar 12 so that the second bar can be slid into and out of engagement with the support as desired. A connector in the form of an eye bolt 22 extends through suitable holes formed in the top and bottom walls of the mid-portion of support 20. The threaded shank of the connector is disposed between the adjacent ends of bars 10 and 12 and has a nut 24 threaded onto the lower end thereof to retain the connector in the position shown.

An eyebolt connector 26 is adapted to extend through suitable holes formed in the top and bottom walls of the mid-portion of bar 10, and a nut 28 is adapted to be threaded onto the lower end of the shank: of the connector to retain the connector in position. An eyebolt connector 30 extends through suitable holes formed in the top and bottom walls of the mid-portion of bar 12, and a nut 32 is threaded onto the lower end of the shank of the connector to retain the connector in position.

Hand grips 34 and 36 are adapted to be supported on bars 10 and 12 respectively. The hand grips include steel pins 38 and 40 which are adapted to be seated in suitable slots in bars 10 and 12 respectively so that the hand grips are adapted to pivot about the longitudinal axes of the pins 38 and 40 and swing in a vertical plane bisecting the bars 10 and 12 respectively. This plane will also pass through the axes of the shanks of the connectors 22, 26 and 30 when the device is in the assembled position shown in FIG. 2.

Figure 2:
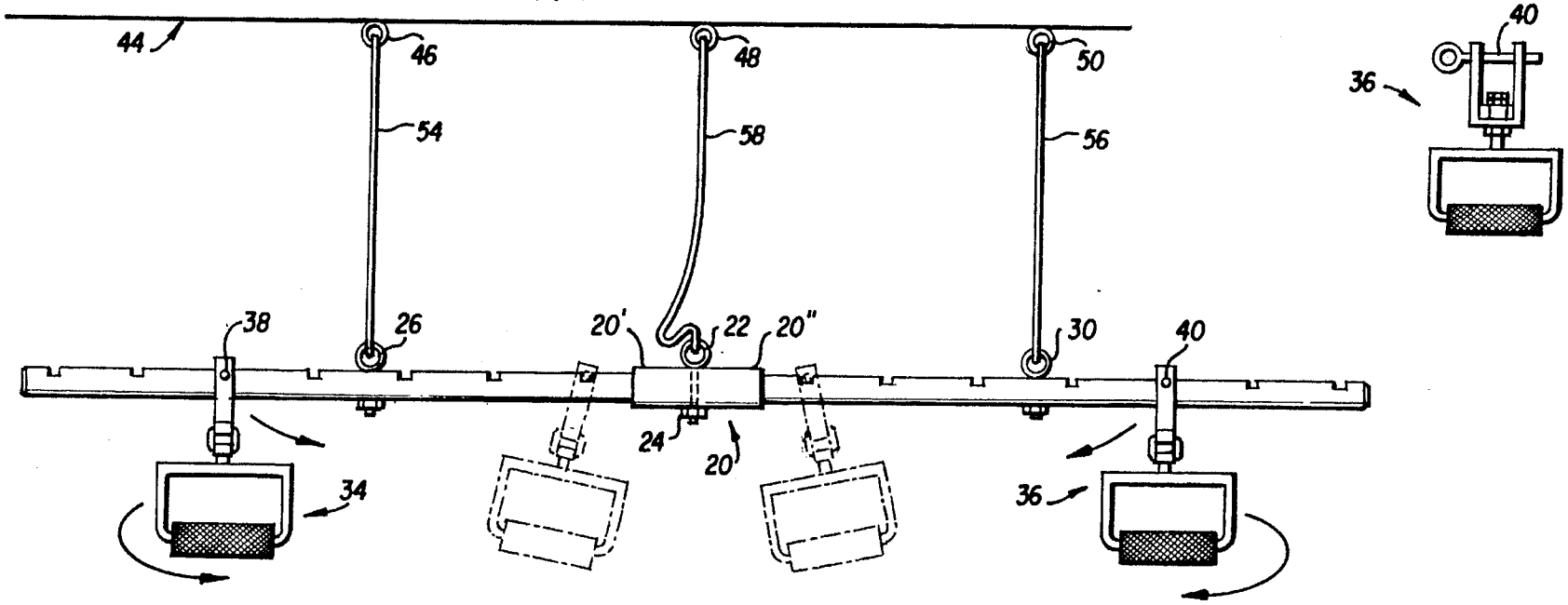
FIG. 2 is a view showing the device anchored overhead.

As seen in FIG. 2, the device is shown as being mounted as a chin up bar to an overhead wood rafter, the undersurface of which is indicated by line 44. Woodscrew eyebolts 46, 48 and 50 having a diameter of at least 5/16 inch and a threaded length of at least 1½ inch are screwed into the rafter and epoxied into place with a strong wood epoxy. Connectors 26 and 30 are connected to eyebolts 46 and 50 respectively by chains 54 and 56 with no slack in the chains. Chains 54 and 56 normally support the device in the operative position shown. A further chain 58 connects connector 22 with eyebolt 48 with some slack in the chain. Chain 58 acts as a safety device in case the support for either of connectors 26 or 30 should fail.

Figure 5:
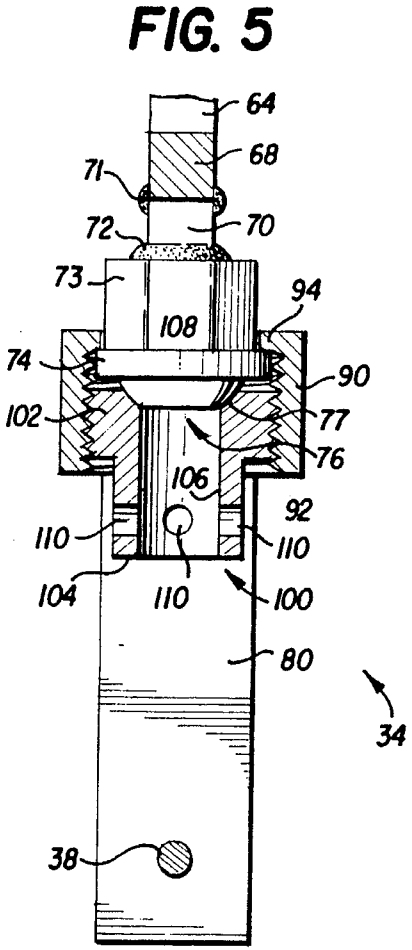
FIG. 5 a section on an enlarged scale taken along line 5—5 of FIG. 3.
Figure 4:
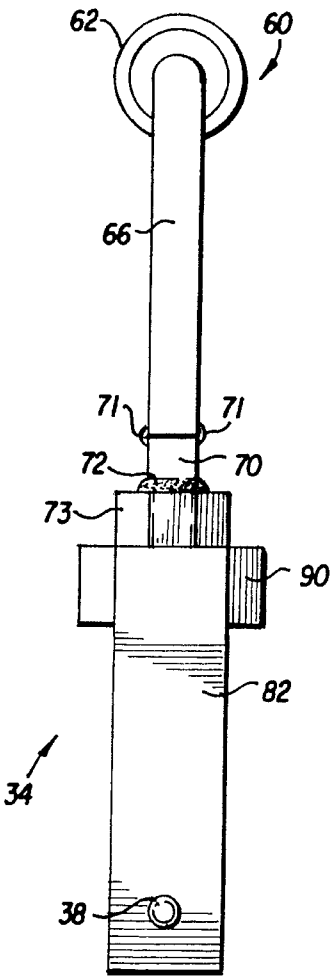
FIG. 4 is a side view of the hand grip shown in FIG. 3.
Figure 3:
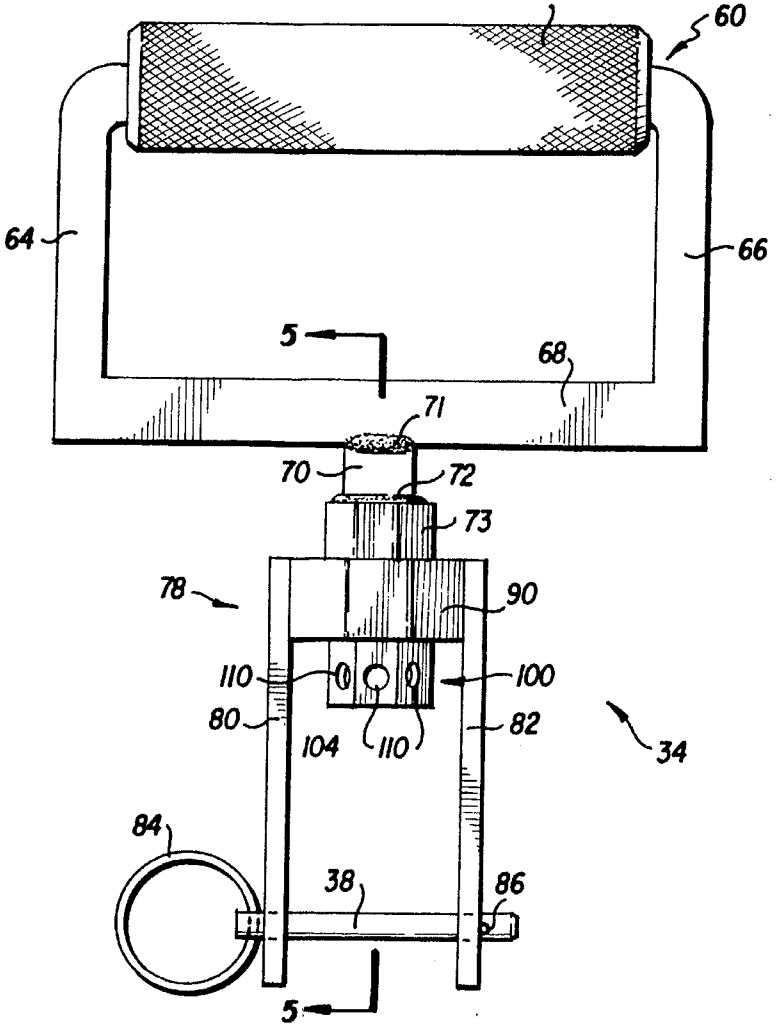
FIG. 3 is enlarged elevation of a hand grip.

Referring now to FIGS. 3–5, the construction of the hand grips is illustrated. Hand grip 34 includes a hand grip portion 60 having a knurled cylindrical portion 62 which is gripped by the hand of a user. Portion 62 is rigidly connected as by welding to a pair of arms 64 and 66 which are in turn interconnected by a cross-member 68. All of these components of the hand grip portion are rigidly interconnected and are formed of steel or the like.

As seen in FIG. 5, the hand grip portion further includes a rigid member 70 formed of steel or the like which is welded at 71 to cross-member 68. Member 70 is in turn welded at 72 to a further member 73 formed of steel or the like, member 73 having an enlarged annular shoulder 74 extending radially outwardly thereof. Member 73 also includes an annular portion 76 which has an outer surface 77 which defines a portion of a spherical surface.

Referring to FIG. 3, the hand grip also includes a mounting portion 78 for mounting the the hand grip portion on a bar. The mounting portion as seen in FIG. 3 includes a pair of spaced generally parallel legs 80 and 82 formed of steel or the like and having suitable holes formed through the outer ends thereof for slidably receiving the pin 38 which rests within one of the slots in an associated bar as previously described. The pin includes a ring 84 extending through a hole formed through one end of the pin, the ring being adapted to receive the finger of a person when the pin is being inserted or removed from its operative position. The opposite end of the pin includes a conventional ball detent 86 for retaining the pin in position relative to the hand grip to ensure that the pin is not accidentally released from the mounting portion of the hand grip during an exercise. The pin provides a means for quickly and easily connecting or disconnecting the hand grip relative to any portion of the associated bar.

The inner ends of arms 80 and 82 are welded to a rigid hollow member 90 formed of steel or the like and having a threaded cylindrical bore 92 formed therein as seen in FIG. 5, the hollow member including a radially inwardly extending shoulder 94 formed at one end thereof for engaging shoulder 74 formed on member 73 of the hand grip portion of the hand grip. This construction provides a swivel connection between the hand grip portion and the mounting portion of the hand grip so that the hand grip portion can swivel through an angle of 360 degrees with respect to the support portion when exercising with the device. The mounting portion may at the same time pivot with respect to the associated supporting bar, and in this manner, the hand grips may be moved into many different positions relative to the supporting bars.

For the purpose of carrying out certain exercises, it is desirable that the hand grip portions of the hand grips be locked in position with respect to the support portions thereof so that the hand grip portions cannot swivel with respect to the support portions. The device is provided with an adjustable locking member 100 formed of steel or the like having a cylindrical portion 102 and a reduced cylindrical portion 104. Portion 102 has threads formed on the outer periphery thereof which are threaded into the threaded cylindrical bore 92 of member 90. A bore 106 is formed through member 100, and a surface 108 is formed at one end of the bore, surface 108 forming a portion of a spherical surface and being complementary in configuration to and engageable with the surface 77 on member 73 of the hand grip portion of the hand grip. Four holes 110 are formed through portion 104 at equally spaced points around the periphery thereof.

When it is desired to lock the hand grip portion in a desired position so that it will not rotate with respect to the support portion of the hand grip, member 100 is rotated so that it is threaded into member 90, thereby bringing surfaces 77 and 108 into tight engagement with one another. These surfaces coact in the same manner as in a conventional plumber's union to prevent relative rotation between members 73 and 90. To assist in tightening member 100 into its locked position, a tool is provided as seen in FIG. 8. This tool includes a plastic handle 120 which carries a cylindrical steel rod 122 which fits snugly within holes 110 of member 100 and which is of sufficient length so that it can be inserted through diametrically opposite holes 110, whereupon pressure on the plastic handle 120 can be applied to turn member 100 into the desired position. When it is desired that the hand grip portions swivel with respect to the support portions of the hand grips, locking member 100 is backed off so that surfaces 77 and 108 are no longer in engagement with one another.

Referring to FIG. 2, hand grips 34 and 36 are shown in dotted lines in the position they would occupy when the grips are mounted as close to one another as possible and are used for pull ups when the device is fully assembled. In FIG. 6, bar 12 has been disassembled from support 20 and connector 30 is connected by a chain 130 to a weight machine for performing a tricep pushdown exercise. A special S-clip may be provided for connecting the device to a weight machine. In FIG. 7, bar 12 is connected by a rope 132 to free weights 134 for performing an upright rowing exercise. Numerous other exercises may be performed wherein the hand grips can be placed in various slots in the rigid bars, and the angle of the hand grips can be varied as required. The hand grip portions can then swivel 360 degrees with respect to the associated support portions of the hand grips, or the hand grip portions can be selectively locked in fixed relationship to the support portions of the hand grips.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. An adjustable exercise device comprising an elongated rigid bar having a longitudinal axis, a pair of spaced hand grips, each hand grip including a hand grip portion adapted to be manually gripped and a mounting portion for mounting the hand grip portion on said bar, said mounting portion being freely pivotally supported by said bar for pivotal movement about a pivot axis extending substantially perpendicular to said longitudinal axis, a swivel connection between said hand grip portion and said mounting portion so that the hand grip portion can swivel relative to said mounting portion through an angle of 360 degrees about an axis of rotation, said axis of rotation being disposed substantially perpendicular to and passing through said pivot axis at the point where said mounting portion is pivotally supported by said bar, said locking means for selectively locking said swivel connection to prevent the hand grip portion form swiveling relative to said mounting portion.

2. A device as defined in claim 1 including a plurality of slots formed in one side of said bar, each mounting portion having means disposed within one of said slots.

3. A device as defined in claim 1 wherein each mounting portion includes a pair of spaced legs, and a pin being carried by said legs and disposed within one of said slots.

4. A device as defined in claim 3 wherein each of said legs of said mounting portions has a hole formed therethrough, said pin extending through said holes, and detent means for holding said pin in position within said holes.

5. A device as defined in claim 1 wherein said locking means includes an adjustable locking member carried by said mounting portion.

6. A device as defined in claim 1 wherein said bar has a mid-portion, and including a connector fixed to the mid-portion of said bar.

7. An adjustable exercise device comprising, in combination, a first rigid bar having opposite ends, a support connected to one end of said first bar, a second rigid bar having opposite ends, said support being connected to one end of said second bar, said first and second bars and said support defining an elongated bar assembly having a longitudinal axis, a pair of hand grips, one of said hand grips being supported by said first bar, the other of said hand grips being supported by said second bar, each hand grip including a hand grip portion adapted to be manually gripped and a mounting portion for mounting the hand grip portion on said bar assembly, said mounting portion being freely pivotally supported by said bar assembly for pivotal movement about a pivot axis extending substantially perpendicular to said longitudinal axis, a swivel connection between said hand grip portion and said mounting portion so that the hand grip portion can swivel relative to said mounting portion through an angle of 360 degrees about axis of rotation, said axis of rotation being disposed substantially perpendicular to and passing through said pivot axis at the point where said mounting portion is pivotally supported by said bar assembly, and locking means for selectively locking said swivel connection to prevent the hand grip portion from swiveling relative to said mounting portion.

8. A device as defined in claim 7 wherein said support is fixed to said one end of the first bar.

9. A device as defined in claim 7 wherein said support has a sliding fit with said one end of the second bar.

10. A device as defined in claim 7 wherein said first bar has a mid-point, said second bar has a mid-portion and said support has a mid-point, and including a first connector connected to the mid-point of said first bar, a second connector connected to the mid-point of said second bar, and a third connector connected to the mid-portion of said support.

11. A device as defined in claim 7 including a plurality of slots formed in one side of each of said bars, each mounting portion having means disposed within one of the slots of the associated bar.

12. A device as defined in claim 7 wherein each mounting portion includes a pair of spaced legs, and a pin being carried by said legs and being disposed within one of the slots of the associated bar.

13. A device as defined in claim 12 wherein each of said legs of said mounting portions has a hole formed therethrough, said pin extending through said holes, and detent means for holding said pin in position within said holes.

14. A device as defined in claim 7 wherein said locking means includes an adjustable locking member carried by said mounting portion.

* * * * *